US009151569B2

(12) United States Patent
Lin et al.

(10) Patent No.: US 9,151,569 B2
(45) Date of Patent: Oct. 6, 2015

(54) SIGHT WITH RESILIENT MEMBER AROUND FRAME SCREW

(71) Applicants: Sintai Optical (Shenzhen) Co., Ltd., Shenzhen, Guandong Province (CN); Asia Optical International Ltd., Tortola (GB)

(72) Inventors: Yung-Chin Lin, Taichung (TW); Chia-Kan Chang, Taichung (TW)

(73) Assignees: SINTAI OPTICAL (SHENZHEN) CO., LTD., Shenzhen, Guandong Province (CN); ASIA OPTICAL INTERNATIONAL LTD., Tortola (VG)

( * ) Notice: Subject to any disclaimer, the term of this patent is extended or adjusted under 35 U.S.C. 154(b) by 0 days.

(21) Appl. No.: 14/071,816

(22) Filed: Nov. 5, 2013

(65) Prior Publication Data

US 2014/0366425 A1 Dec. 18, 2014

(30) Foreign Application Priority Data

Jun. 18, 2013 (TW) ..... 102121497 A

(51) Int. Cl.
*F41G 1/26* (2006.01)

(52) U.S. Cl.
CPC ..... *F41G 1/26* (2013.01)

(58) Field of Classification Search
USPC ..... 42/135–139
See application file for complete search history.

(56) References Cited

U.S. PATENT DOCUMENTS

| | | | | | |
|---|---|---|---|---|---|
| 2,127,565 | A | * | 8/1938 | King et al. | 42/137 |
| 2,162,090 | A | * | 6/1939 | King | 42/137 |
| 2,343,802 | A | * | 3/1944 | Rodney | 42/137 |
| 2,407,437 | A | * | 9/1946 | Mossberg | 42/137 |
| 2,792,632 | A | * | 5/1957 | Pinkerton, Jr. | 42/137 |
| 2,963,789 | A | * | 12/1960 | Wilhelm | 42/137 |
| 3,854,217 | A | * | 12/1974 | Killian | 33/265 |
| 3,925,902 | A | * | 12/1975 | Gevers | 42/137 |
| 4,142,298 | A | * | 3/1979 | Killian | 33/265 |
| 4,651,432 | A | * | 3/1987 | Bornancini | 42/133 |
| 4,761,888 | A | * | 8/1988 | Kudlacek | 33/265 |
| 5,092,052 | A | * | 3/1992 | Godsey | 33/265 |
| 5,481,818 | A | * | 1/1996 | Stover | 42/136 |
| 5,507,272 | A | * | 4/1996 | Scantlen | 124/87 |
| 5,651,185 | A | * | 7/1997 | Vanderheyden et al. | 33/265 |
| 5,722,175 | A | * | 3/1998 | Slates | 33/265 |
| 6,119,672 | A | * | 9/2000 | Closson | 124/87 |

* cited by examiner

*Primary Examiner* — Michael David
(74) *Attorney, Agent, or Firm* — McClure, Qualey & Rodack, LLP

(57) ABSTRACT

A sight includes a power-changed unit and a bullet impact correction unit. The power-changed unit includes an outer barrel, a rotary frame disposed around the outer barrel, a frame screw disposed in the rotary frame, and a resilient member disposed between the outer barrel and the frame screw. The bullet impact correction unit includes an elevation adjustment screw and a windage adjustment screw, both of which abut the power-changed unit.

7 Claims, 14 Drawing Sheets

SIGHT WITH RESILIENT MEMBER AROUND FRAME SCREW

BACKGROUND OF THE INVENTION

1. Field of the Invention

The invention relates to a sight for avoiding adjustment deviation or component stuck situation.

2. Description of the Related Art

FIG. 1 illustrates a conventional sight, wherein some components (such as an enclosure 11 of FIG. 2) are not shown in the figure for simplification. The sight 10 includes a power-changing unit 12 for a user to change the multiplying power of the power-changing unit 12 for clearly observing a target by rotating the rotary frame 123 according to the distance to the target.

FIG. 2 is a schematic view of the sight 10 observed in a direction A1 of FIG. 1, wherein the conventional sight 10 further includes a bullet impact correction unit 14. The bullet impact correction unit 14 includes an elevation adjusting screw 141 and a windage adjusting screw 142 which are both disposed on the enclosure 11 to abut the power-changing unit 12. In operation, the elevation adjusting screw 141 and the windage adjusting screw 142 are driven to abut the power-changing unit 12 so that the power-changing unit 12 can be rotated with respect to a center C1, thereby adjusting elevation and windage to correct the bullet impact point. FIG. 3 illustrates a position change of the power-changing unit 12 with respect to the enclosure 11 after the elevation and windage adjustments.

As shown in FIG. 1, a frame screw 126 is disposed in the rotary frame 123. FIG. 4 is a partial enlarged view of FIG. 1, wherein an opening 1211 is disposed in an outer barrel 121 of the power-changing unit 12. The frame screw 126 extends into the opening 1211, so that the outer barrel 121 can be rotated by the rotary frame 123 through the frame screw 126 in multiplying power operation. An end 1261 of the frame screw 126 is designed to be spherical so that the power-changing unit 12 can be rotated with respect to the center C1 for correcting a bullet impact offset, and the detail is as follows:

During the elevation adjustment, the power-changing unit 12 is rotated with respect to the center C1 to move vertically (in directions perpendicular to the ground). As shown in FIG. 5, the end 1261 of the frame screw 126 is designed to be spherical, thus without affecting the rotation of the power-changing unit 12 and the elevation adjustment.

During the windage adjustment, however, the power-changing unit 12 is rotated with respect to the center C1 to move horizontally. If the windage adjustment screw 142 moves largely, the spherical end 1261 of the frame screw 126 will interfere with the opening 1211 so that the bullet impact offset cannot be accurately corrected. In a serious case, some components (such as the frame screw, the elevation adjustment screw, and the windage adjustment screw) even get stuck.

FIGS. 6 and 7 respectively illustrate the relative positions of the spherical end 1261 and the opening 1211 before and after the windage adjustment. As shown in FIG. 6, before the windage adjustment, the spherical end 1261 and the opening 1211 do not interfere with each other. During the windage adjustment, however, the opening 1211 (or the power-changing unit 12) is rotated with respect to the center C1 in a direction D1 so that the spherical end 1261 and the opening 1211 seriously interfere with each other as shown in FIG. 7.

BRIEF SUMMARY OF THE INVENTION

According to the above or other objects, the invention provides a sight including a power-changing unit and a bullet impact correction unit. The power-changing unit includes an outer barrel, a rotary frame disposed around the outer barrel, a frame screw disposed in the rotary frame, and a resilient member disposed between the outer barrel and the frame screw. The bullet impact correction unit includes an elevation adjusting screw and a windage adjusting screw which both abut the power-changing unit. During the elevation and windage adjustments, the compression of the resilient member can prevent the frame screw and the outer barrel from interfering with each other, thus avoiding adjustment deviation and even component stuck situation.

In an exemplary embodiment, the sight of the invention includes an opening disposed in the outer barrel to accommodate the frame screw and the resilient member.

In another exemplary embodiment, the resilient member is disposed between the outer barrel and an end of the frame screw.

In yet another exemplary embodiment, the resilient member is disposed around an end of the frame screw.

In another exemplary embodiment, the resilient member is a round pipe and the end of the frame screw is substantially cylindrical.

In yet another exemplary embodiment, the power-changing unit further includes a light collecting lens chamber, and the elevation adjustment screw and the windage adjusting screw both abut the light collecting lens chamber.

In another exemplary embodiment, the resilient member is made of rubber material.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
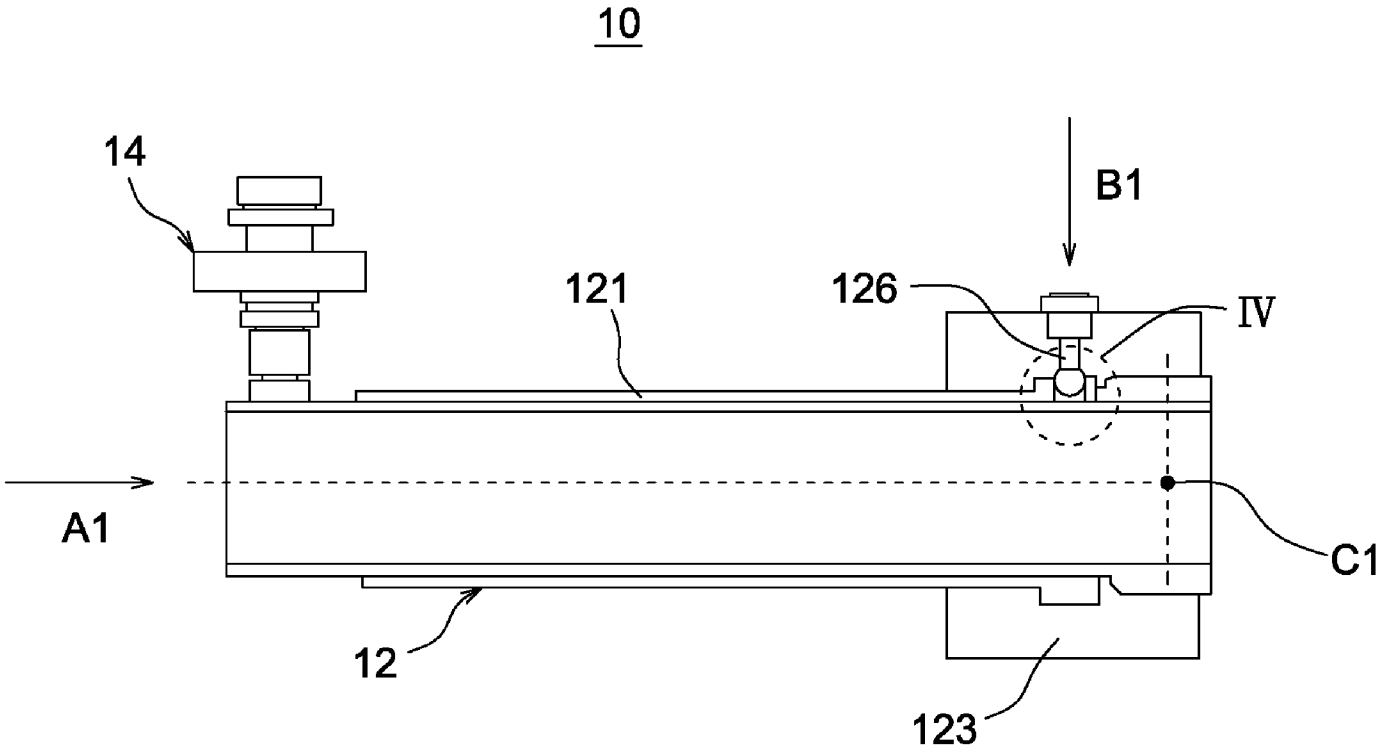
Fig. 1 (PRIOR ART)
FIG. 1 illustrates a conventional sight.
Figure 2:
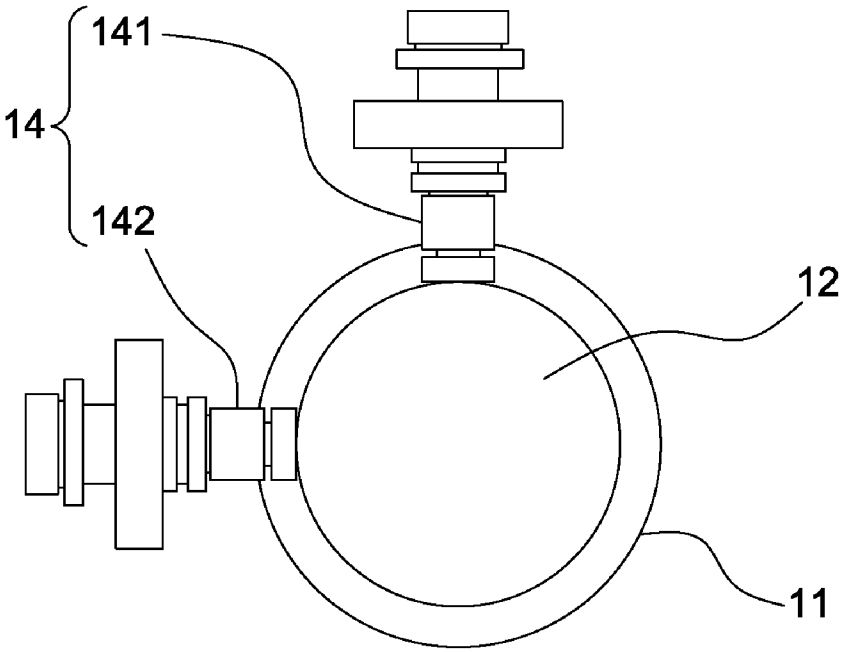
Fig. 2 (PRIOR ART)
FIG. 2 is a schematic view of the sight observed in a direction A1 of FIG. 1.
Figure 3:
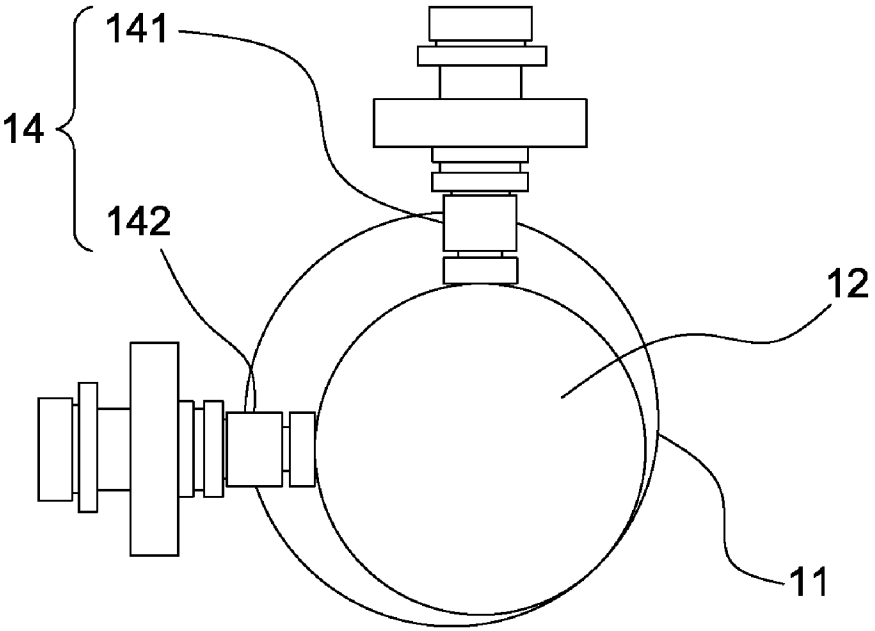
Fig. 3 (PRIOR ART)
FIG. 3 illustrates a position change of the power-changing unit with respect to the enclosure after the elevation and windage adjustments.
Figure 4:
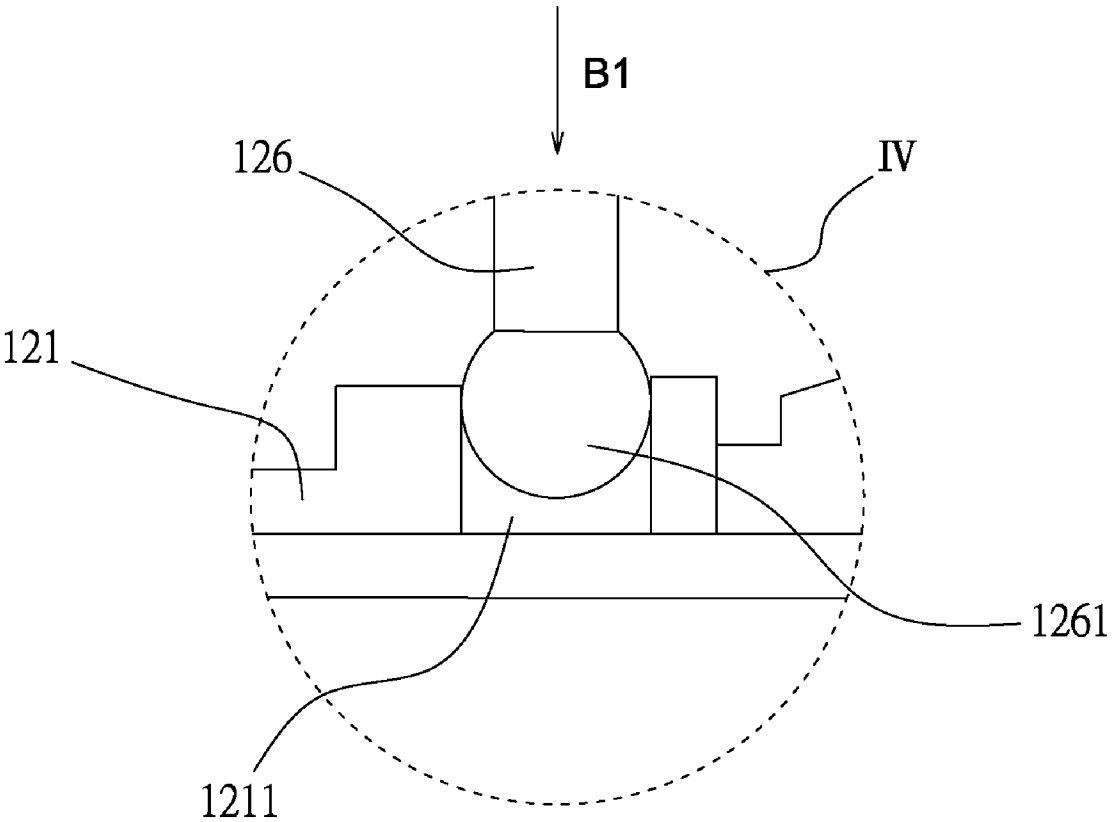
Fig. 4 (PRIOR ART)
FIG. 4 is a partial enlarged view of FIG. 1.
Figure 5:
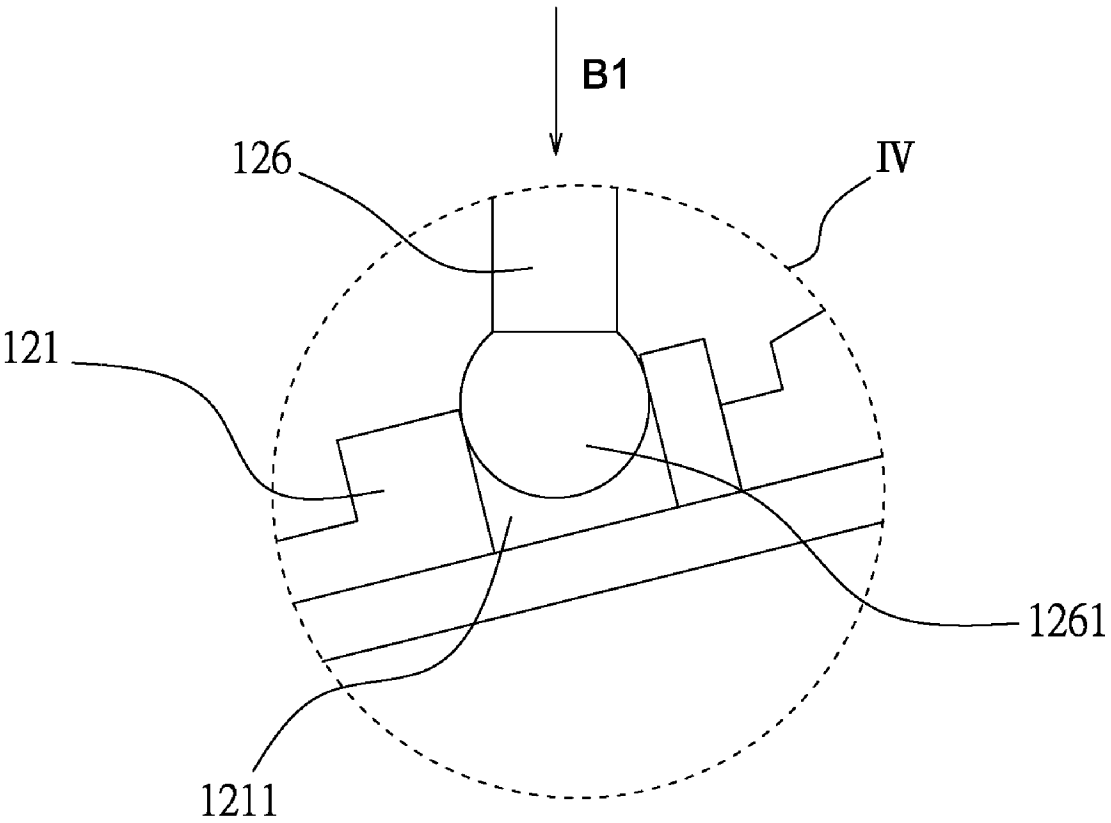
Fig. 5(PRIOR ART)
FIG. 5 is a partial enlarged view of FIG. 1 after elevation adjustment.
Figure 6:
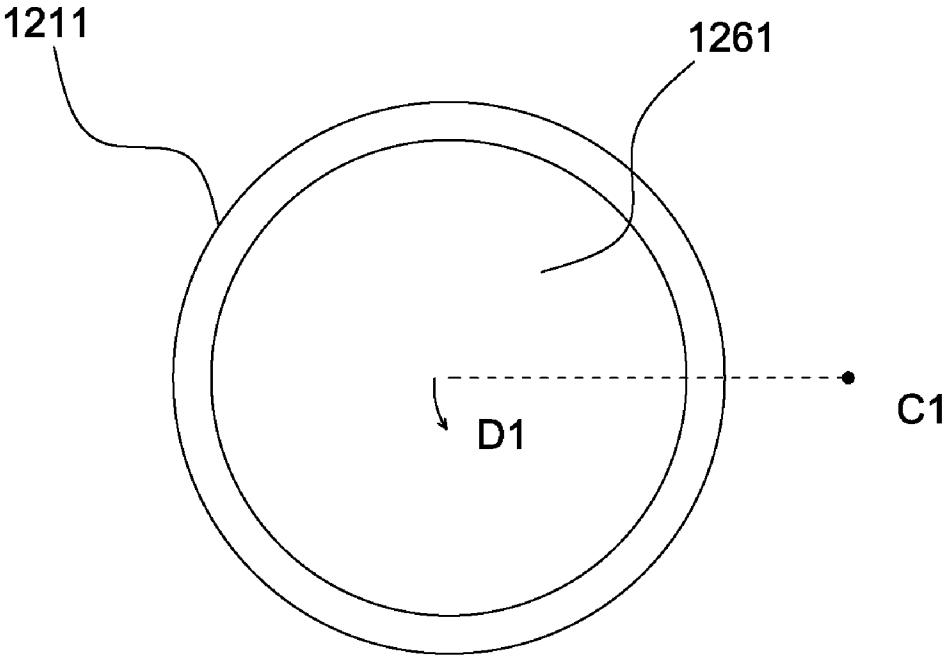
Fig. 6 (PRIOR ART)
FIG. 6 is a schematic diagram of the spherical end and the opening before the windage adjustment, observed in a direction B1 of FIG. 4.
Figure 7:
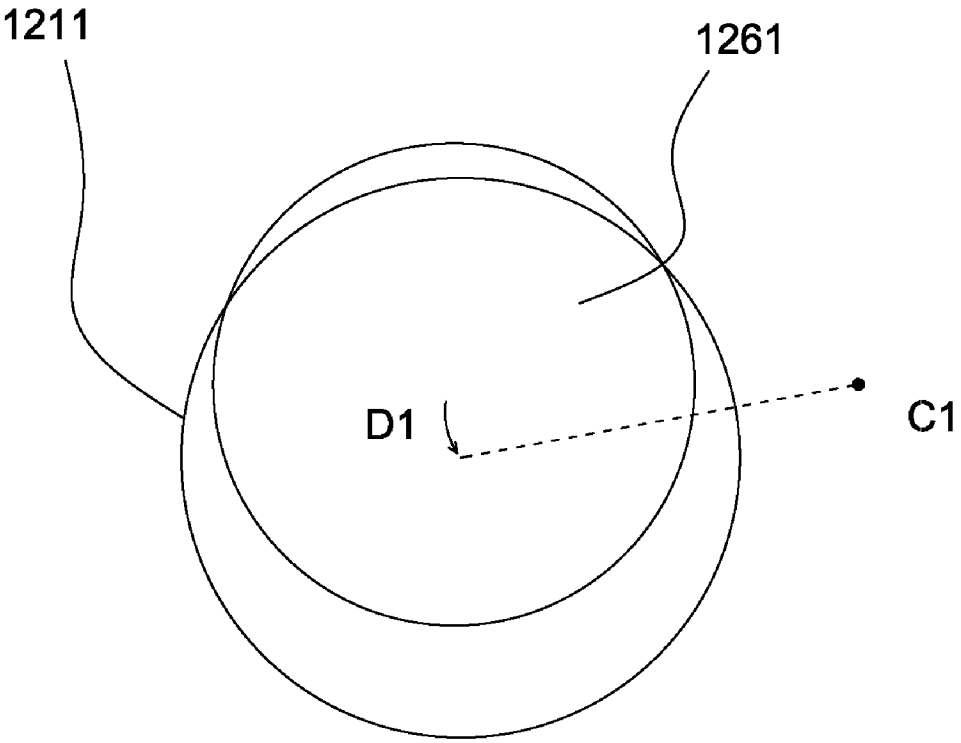
Fig. 7 (PRIOR ART)
FIG. 7 is a schematic diagram of the spherical end and the opening interfering with each other after the windage adjustment, observed in a direction B1 of FIG. 4.
Figure 8:
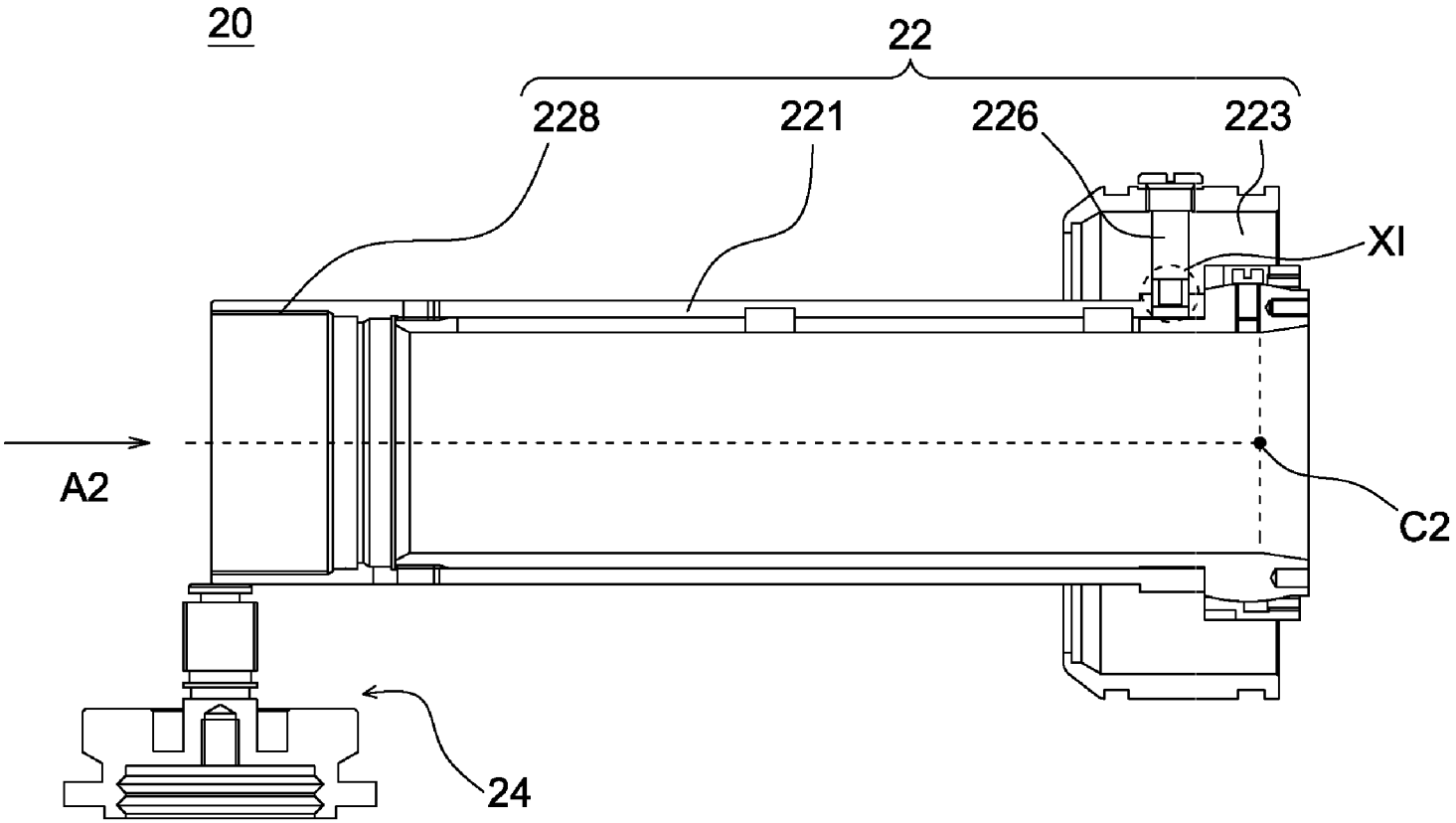
FIG. 8 illustrates a sight according to the invention.

FIG. 8 illustrates a sight 20 in accordance with an embodiment of the invention, wherein some components (such as an enclosure 21 shown in FIG. 9) are not shown for simplification. The sight 20 includes a power-changing unit 22 for a user to change the multiplying power for clearly observing a target by rotating a rotary frame 223 according to a distance to the target.

Figure 9:
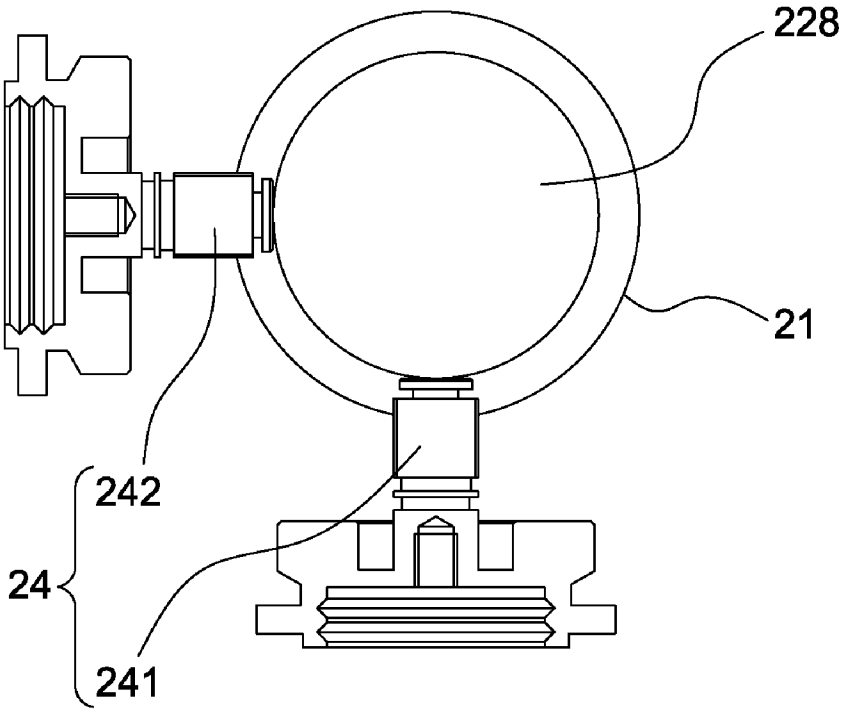
FIG. 9 is a schematic view of the sight observed in a direction A2 of FIG. 8.

FIG. 9 is a schematic view of the sight 20 observed in a direction A2 of FIG. 8, wherein the sight 20 further includes a bullet impact correction unit 24. The bullet impact correction unit 24 includes an elevation adjustment screw 241 and a windage adjusting screw 242 both of which are disposed on an enclosure 21 and abut a light collecting lens chamber 228 of the power-changing unit 22.

Figure 10:
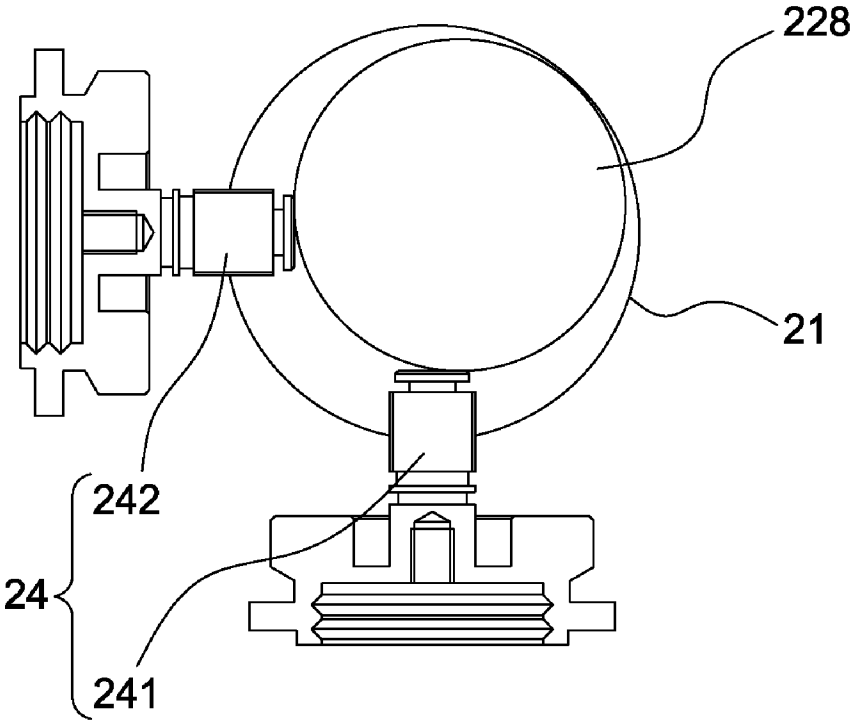
FIG. 10 illustrates a position change of the power-changing unit with respect to the enclosure after the elevation and windage adjustments according to the invention.

In operation, the elevation adjustment screw 241 and the windage adjusting screw 242 are driven to abut the light collecting lens chamber 228 of the power-changing unit 22 so that the power-changing unit 22 can rotate with respect to a center C2, thereby adjusting elevation and windage to correct the bullet impact point. FIG. 10 illustrates a position change of the light collecting lens chamber 228 (or the power-changing unit 22) with respect to the enclosure 21 after the elevation and windage adjustments.

Figure 11:
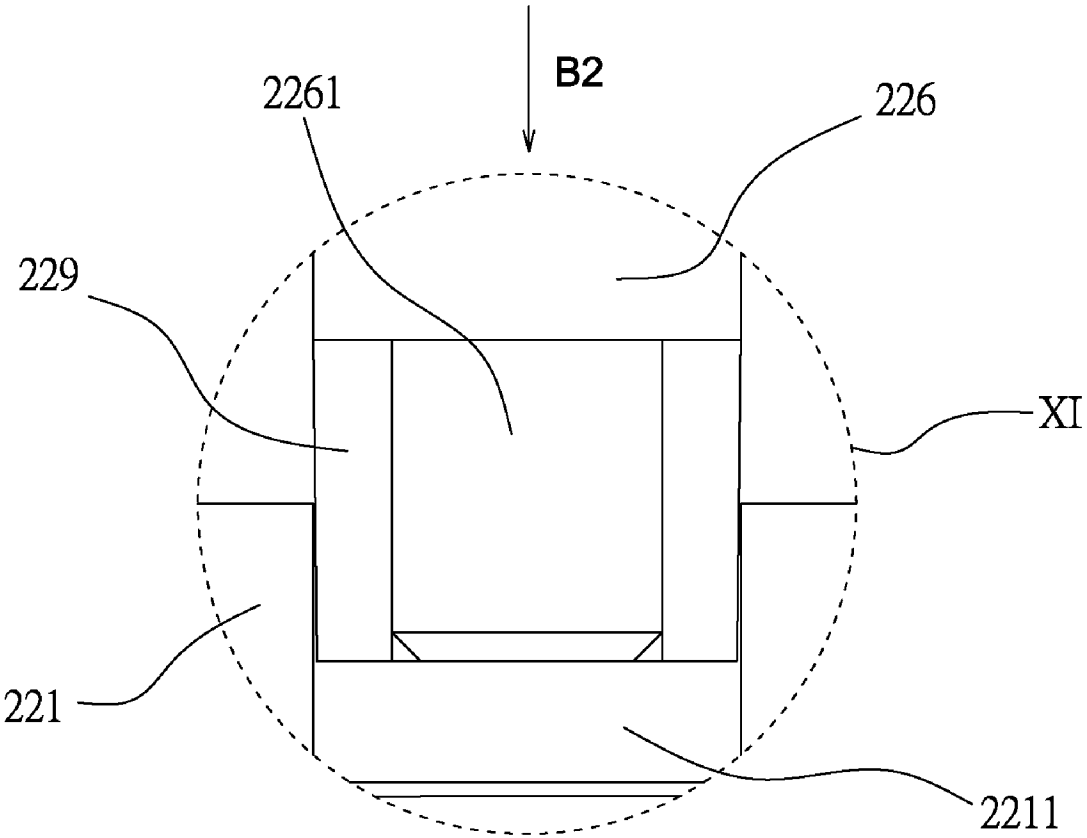
FIG. 11 is a partial enlarged view of FIG. 8.

Referring to FIG. 8, a frame screw 226 is disposed in the rotary frame 223. Referring to FIG. 11, a partial enlarged view of FIG. 8, an opening 2211 is disposed in an outer barrel 221 of the power-changing unit 22. A resilient member 229 is disposed around an end 2261 of the frame screw 226, which extends into the opening 2211 so that the outer barrel 221 can be rotated by the rotary frame 223 through the frame screw 226 in multiplying power operation.

In an exemplary embodiment of the invention, the end 2261 of the frame screw 226 is substantially cylindrical and the resilient member 229 is a round pipe.

In an exemplary embodiment of the invention, the resilient member 229 is made of rubber material.

Figure 12:
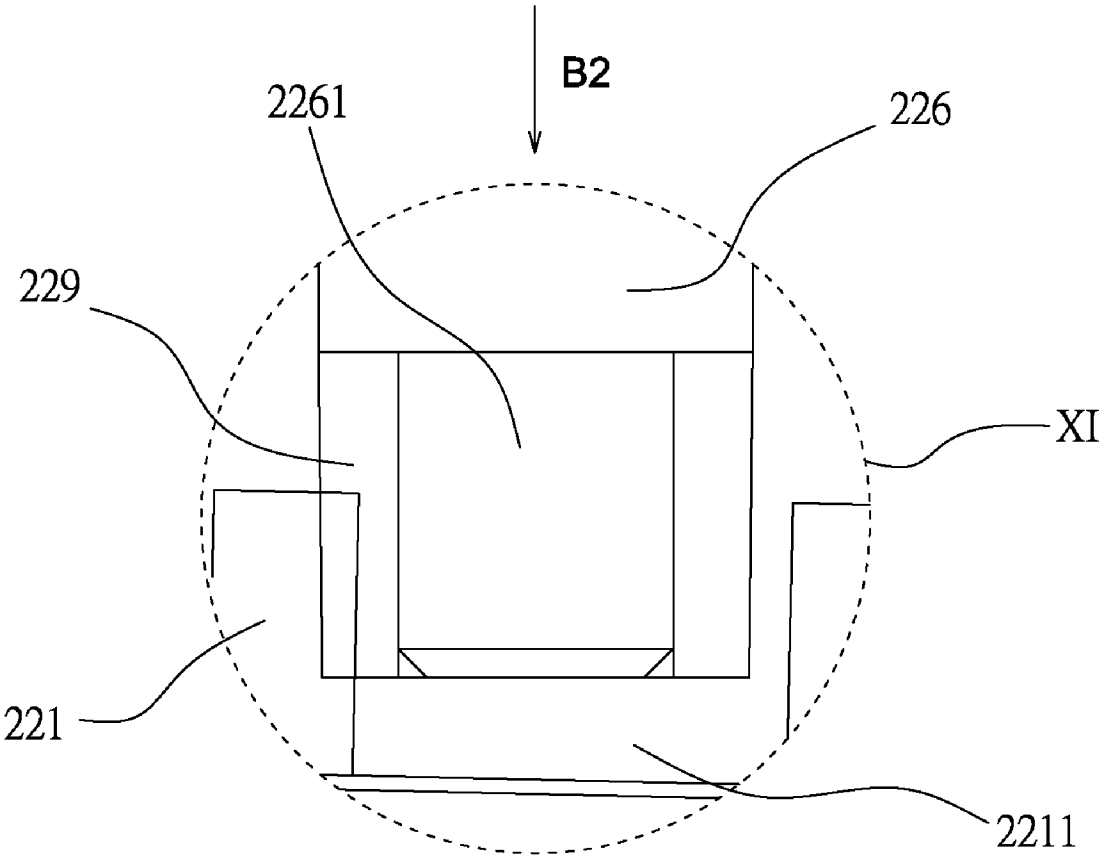
FIG. 12 is a partial enlarged view of FIG. 8 after elevation adjustment.

During elevation adjustment, the power-changing unit 22 is rotated with respect to the center C2 to move vertically (in directions perpendicular to the ground). As shown in FIG. 12, the resilient member 229 is compressed to deform, thus without affecting the rotation of the power-changing unit 22 and the bullet impact correction.

Figure 13:
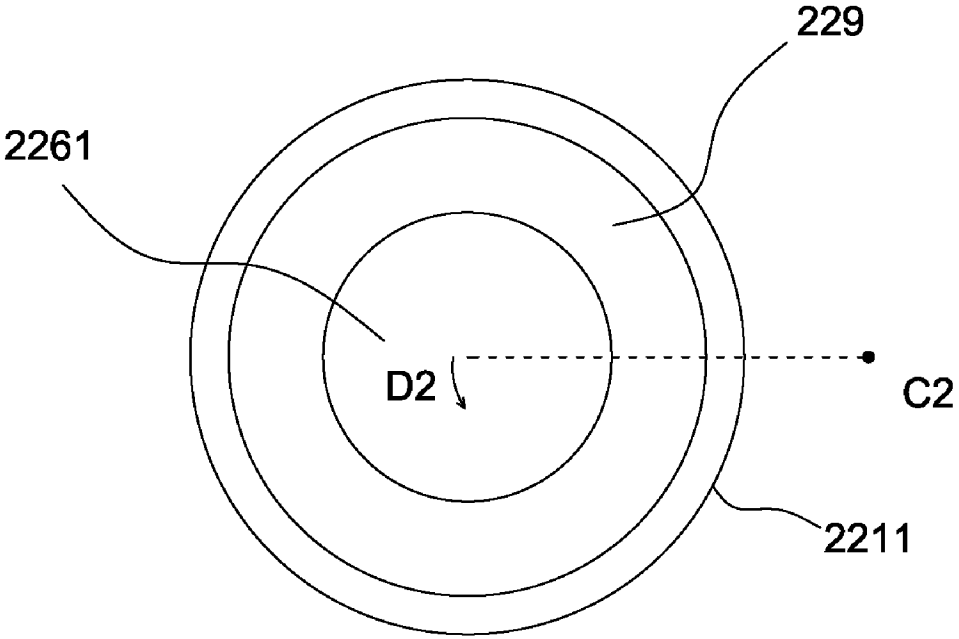
FIG. 13 is a schematic diagram of the spherical end and the opening before the windage adjustment, observed in a direction B2 of FIG. 11.
Figure 14:
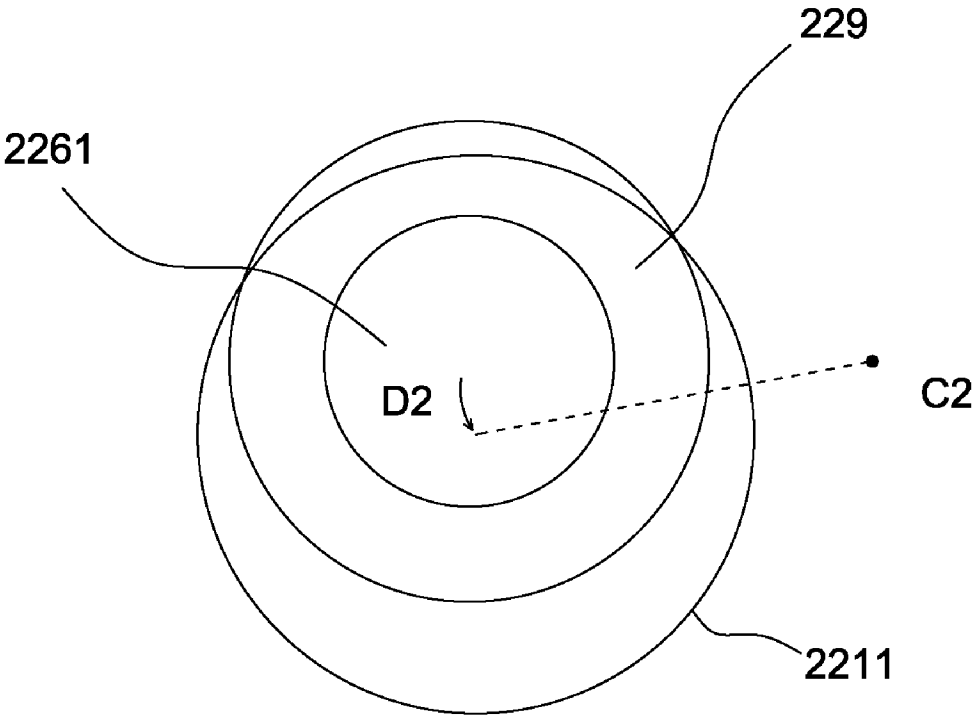
FIG. 14 is a schematic diagram of the spherical end and the opening interfering with each other after the windage adjustment, observed in a direction B2 of FIG. 11.

During the windage adjustment, the power-changing unit 22 is rotated with respect to the center C2 to move horizontally, which is not affected either. FIGS. 13 and 14 illustrate a relative position change of the end 2261 of the frame screw 226 and the opening 2211 before and after the windage adjustments. During the windage adjustment, the opening 2211 (or the power-changing unit 22) is rotated with respect to the center C2 in a direction D2. As shown in FIG. 14, the resilient member 229 is compressed to deform so that the end 2261 and the opening 2211 do not interfere with each other, thereby avoiding adjustment deviation and even component stuck situation.

The resilient member 229 of the invention is disposed around the end 2261 of the frame screw 226 for providing following benefits due to its compressible and restorable characteristics:

During operation of the rotary frame 223, the resilient member 229 is slightly and temporarily compressed that does not affect the multiplying power operation.

During the elevation and windage adjustments, the resilient member 229 is severely and permanently compressed to avoid the adjustment deviation and even component stuck situation (such as the frame screw, the elevation adjustment screw, or the windage adjustment screw stuck situation).

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sight, comprising:

a power-changing unit, including an outer barrel, a rotary frame disposed around the outer barrel, a frame screw which comprises an end and is disposed in the rotary frame, and a spacer which is disposed between the outer barrel and the end of the frame screw and deformable elastically so as to allow the frame screw to move in the rotary frame without interference; and a bullet impact correction unit, including an elevation adjustment screw and a windage adjusting screw which both abut the power-changing unit.

2. The sight as claimed in claim 1, wherein an opening is disposed in the outer barrel to accommodate the frame screw and the resilient member.

3. The sight as claimed in claim 1, wherein the frame screw comprises an end, and the resilient member is disposed between the outer barrel and the end of the frame screw.

4. The sight as claimed in claim 1, wherein the frame screw comprises an end, and the spacer is disposed around the end of the frame screw.

5. The sight as claimed in claim 4, wherein the resilient member is substantially a round pipe and the end of the frame screw is substantially cylindrical.

6. The sight as claimed in claim 1, wherein the power-changing unit further includes a light collecting lens chamber, and the elevation adjustment screw and the windage adjusting screw both abut the light collecting lens chamber.

7. The sight as claimed in claim 1, wherein the resilient member is made of rubber material.

* * * * *